US011155941B2

(12) United States Patent
Hufenbach

(10) Patent No.: US 11,155,941 B2
(45) Date of Patent: Oct. 26, 2021

(54) CIRCULAR LOOM WITH ORBIT PATH

(71) Applicant: INNOTEC LIGHTWEIGHT ENGINEERING & POLYMER TECHNOLOGY GMBH, Goslar (DE)

(72) Inventor: Werner Hufenbach, Dresden (DE)

(73) Assignee: INNOTEC LIGHTWEIGHT ENGINEERING & POLYMER TECHNOLOGY GMBH, Goslar (DE)

( * ) Notice: Subject to any disclaimer, the term of this patent is extended or adjusted under 35 U.S.C. 154(b) by 0 days.

(21) Appl. No.: 16/935,388

(22) Filed: Jul. 22, 2020

(65) Prior Publication Data

US 2021/0032784 A1 Feb. 4, 2021

(30) Foreign Application Priority Data

Jul. 24, 2019 (DE) ..... 102019120035.7
Jul. 24, 2019 (DE) ..... 102019120037.0

(51) Int. Cl.

| | |
|---|---|
| ***D03D 37/00*** | (2006.01) |
| ***D03D 49/52*** | (2006.01) |
| ***D03D 51/02*** | (2006.01) |
| ***D03D 27/02*** | (2006.01) |
| *D03D 41/00* | (2006.01) |

(52) U.S. Cl.

CPC ..... *D03D 37/00* (2013.01); *D03D 27/02* (2013.01); *D03D 49/52* (2013.01); *D03D 51/02* (2013.01)

(58) Field of Classification Search

CPC ..... D03D 37/00; D03D 27/02; D03D 49/52; D03D 51/02; D03D 13/00

See application file for complete search history.

(56) References Cited

U.S. PATENT DOCUMENTS

| | | | | | |
|---|---|---|---|---|---|
| 920,728 | A | | 5/1909 | Chernack | |
| 3,749,135 | A | * | 7/1973 | Linka | D03D 47/267 139/458 |
| 3,871,413 | A | * | 3/1975 | Torii | D03D 37/00 139/459 |
| 3,961,648 | A | * | 6/1976 | Torii | D03D 37/00 139/458 |
| 4,234,021 | A | * | 11/1980 | Clokie | D03D 51/34 139/371 |
| 4,316,488 | A | * | 2/1982 | Manini | D03D 37/00 139/458 |
| 4,355,666 | A | * | 10/1982 | Torii | D03D 51/40 139/458 |

(Continued)

FOREIGN PATENT DOCUMENTS

| | | | |
|---|---|---|---|
| CN | 1308153 | A | 8/2001 |
| FR | 2030124 | A1 | 10/1970 |

(Continued)

*Primary Examiner* — Robert H Muromoto, Jr.

(74) *Attorney, Agent, or Firm* — Abel Schillinger, LLP

(57) ABSTRACT

A circular loom for weaving a weaving core with at least one shuttle, which has a weft thread spool and is movable along a circular orbit path around the weaving core. At least one guide device, designed to guide at least one warp thread provided from a warp thread spool on a warp spool device, is movably arranged or designed outside a track plane enclosed by the outer circumference of the circular orbit path, the guided warp thread, crossing the track plane, passing through a recess in the circular orbit path.

16 Claims, 9 Drawing Sheets

(56) References Cited

U.S. PATENT DOCUMENTS 4,424,836 A * 1/1984 Torii ..... D03D 37/00 139/457
4,432,397 A * 2/1984 Cacciapuoti ..... D03D 37/00 139/458
4,479,517 A * 10/1984 Plammer ..... D03D 37/00 139/436
4,509,562 A * 4/1985 Schonberger ..... D03D 37/00 139/457
4,619,293 A * 10/1986 Huemer ..... D03D 49/62 139/458
4,658,862 A * 4/1987 Huemer ..... D03D 51/002 139/457
4,719,946 A * 1/1988 Buchinger ..... D03D 37/00 139/458
4,776,371 A * 10/1988 Schonberger ..... D03D 37/00 139/458
4,977,933 A * 12/1990 Brais ..... D03D 37/00 139/15
5,099,891 A * 3/1992 Hiramatsu ..... D03D 37/00 139/457
5,293,906 A * 3/1994 Amin ..... D03D 37/00 139/309
5,617,905 A * 4/1997 Ziegler ..... D03D 37/00 139/459
10,711,376 B2 * 7/2020 Hufenbach ..... D03D 37/00
2019/0153637 A1 * 5/2019 Hufenbach ..... D03D 37/00
2021/0025087 A1 * 1/2021 Hufenbach ..... D03D 37/00

FOREIGN PATENT DOCUMENTS

FR 2339009 A1 8/1977
JP H01168938 A 7/1989
WO 2017190739 A1 11/2017

* cited by examiner

CIRCULAR LOOM WITH ORBIT PATH

CROSS-REFERENCE TO RELATED APPLICATIONS

The present application claims priority under 35 U.S.C. § 119 of German Patent Application Nos. 102019120035.0 and 102019120037.7, both filed on Jul. 24, 2019, the entire disclosures of which are expressly incorporated by reference herein.

BACKGROUND OF THE INVENTION

1. Field of the Invention

The invention relates to a circular loom for weaving a weaving core with at least one shuttle, which has a weft thread spool and is movable along a circular orbit path around the weaving core.

2. Discussion of Background Information

Known circular looms and weaving processes on circular looms are used in the production of hollow-profile, tubular textiles for items such as fire hoses, water hoses, sacks or wheel rims, etc.

A circular loom of the above-stated type is known from publication WO2017/190739 A1, the entire disclosure of which is incorporated by reference herein.

One or more shuttles, each with a weft thread spool, are moved along a circular orbit path, guiding the weft thread in a circuit around the weaving core.

Furthermore, such circular looms are equipped with warp spool devices. Warp spool devices essentially have, in addition to a warp thread spool with warp thread, a holder for the warp thread spool (warp spool holder) and a thread tensioning device.

The warp spool devices are arranged directly adjacent to a weaving plane that is radially enclosed by the circular orbit path and determined by the circumferential course of the weft thread around the weaving core.

The warp spool devices are designed to be movable, with the movement path of the warp spool devices taking place through the weaving plane in order to create what is known as a shed of the warp threads as a result of their changing positioning and to generate a weave with the weft thread. This largely eliminates a separate thread guide or thread deflector for the warp threads.

With this circular loom, by applying high thread tension to the weft threads and warp threads it is possible to generate a fabric that sits tightly on the weaving core and is of high weaving quality and weaving variability.

Experience shows, however, that the manoeuvrability of the warp spool devices through the weaving plane is constructively extremely complex, while in particular also the maintenance of an even thread tension while moving the warp spools relative to the weaving plane and to the weaving core places high technical demands on the design of the circular loom.

In addition, the movement of the warp spool devices requires increased mechanical and control-technology complexity. In addition to the necessary controlling of an acceleration and braking procedure for the really large masses, the rapid movement of the warp spool devices and the rapid exit of the warp spool devices and their positioning devices from the weaving plane means high constructive complexity for the passing of the weft thread spool, with the movement times and exit times limiting the maximum possible speed of the weft thread spool.

In the case of the circular loom according to publication FR 2339009 A1, the entire disclosure of which is incorporated by reference herein, the warp spool devices are pivotably mounted on a peripheral housing, while the warp threads are alternately fed in a fanned out manner—by the thread guide tubes crossing in alternating directions the track for the running path of the shuttles—to the weaving core or rather the weaving plane by means of thread guide tubes that are connected to the pivotable warp spool devices. For this purpose, the track is formed with gaps in it, in particular with wide slots for the thread guide tubes to pass through, whereby the thread guide tubes assume their changing positions along the slots.

This circular loom also requires a complicated mechanical and control-technology design for the movement of the warp spool devices, with the speed of the shuttles being limited by the transition times of the thread guide tubes.

In addition, the pivoting of the thread guide tubes, in which the warp thread is guided at different angles to the outlet of the thread guide tube and rubs on the inner wall of the tube, results in not inconsiderable abrasion of the thread. Because of this risk of damage, circular looms of this kind are not suitable for processing particularly delicate threads such as carbon fibers. This largely prevents the use of these circular looms for producing fiber preforms for fiber-composite products.

As the thread guide tubes pivot in a circular arc, the thread tension of the warp thread near the weaving point decreases considerably, which in addition to a very loose fabric can also result in a messy weave pattern with tangling.

Relatively large slots or gaps have to be provided to let the thread guide tubes through the track, with the result that these track interruptions cause the shuttles to pass very bumpily over the slits resulting in a very inhomogeneous orbit of the shuttle, which in turn leads to unwanted vibrations in the circular loom and to further fluctuations in thread tension.

In view of the foregoing, it would be advantageous to have available an improved circular loom which eliminates the disadvantages of the prior art and enables higher weaving productivity, in particular by simpler constructive means.

Furthermore, it is desirable to ensure improved functionality of the circular loom for producing a hollow-profile fabric of high weaving quality and weaving variability.

SUMMARY OF THE INVENTION

The present invention provides a circular loom for weaving a weaving core with at least one shuttle, which comprises a weft thread spool and is movable along a circular orbit path around the weaving core, according to which at least one guide device designed to guide at least one warp thread provided from a warp thread spool of a warp spool device is provided, which is movably arranged or designed outside a track plane enclosed by the outer circumference of the circular orbit path, the guided warp thread, crossing the track plane, passing through a recess in the circular orbit path.

One or more shuttles move with their weft thread spools along a circular orbit path, which may for example be formed mechanically or electromagnetically, and which determines the conveying or guiding line for the concentric conveying or guiding of the shuttle around the weaving core.

The shuttle(s) can actively, e.g. preferably by means of its/their own electrically powered direct drive, move along the orbit path, or the shuttle(s) can be passively, e.g. by means of an externally driven, rotatable mechanical carrier or by means of an electromagnetic drive, conveyed and steered along the orbit path.

In relation to the axially directed weaving axis of the circular loom, the circular orbit path is preferably arranged aligned radially (perpendicular to the weaving axis), as a result of which the circular loom has a particularly slender design.

For particular applications of the circular loom, however, it may be advantageous to arrange the circular orbit path quasi-radially (at an angle to the weaving axis which is not equal to 90°).

The radially outer circumference of the circular orbit path forms the radial boundary of the track plane of the circular loom, within which the orbit of the shuttle(s) with the weft thread is effected. The axially outer width of the circular orbit path forms the axial boundary of the track plane of the circular loom, within which the orbit of the shuttle(s) with the weft thread is effected. The outer boundary points of the circular orbit path describe the track plane essentially as a circular disc.

The warp spool devices with the warp thread spools are preferably located in the immediate vicinity of the track plane so that the warp threads can be guided to the weaving core on paths that are as short as possible.

The warp spool devices may be stationarily arranged, e.g. fixed to part of the housing of the circular loom, or alternatively they may be movably arranged in various positions in relation to the housing of the circular loom.

The guide device (thread guide device) according to the invention serves to guide and alternately position the warp thread(s) (warp thread guide) between its/their provision by the warp spool device(s) and its/their weaving with the weft thread at a weaving point on the weaving core. Here the guide device acts separately from the design and function of the warp spool device(s).

The weaving point describes the moving point at which temporarily the warp threads are woven with the weft threads on the surface of the weaving core.

The guide device is arranged movably outside the track plane or movably designed in fixed arrangement, whereby the moving guide device acts entirely outside the track plane and only the guided warp thread crosses the track plane and in doing so passes through the associated recess in the circular orbit path.

Subject to the aforementioned condition, the moving guide device can e.g. be fastened to or movably mounted on a radial outer wall of the machine housing of the circular loom or on the radially outer circumference of the circular orbit path.

Preferably several guide devices are arranged around the circumference of the circular orbit path.

In each case one guide device may be provided for guiding in each case one warp thread from a warp spool device, or in each case one guide device may be provided for guiding several warp threads from a group of warp spool devices, or a single guide device may be provided for guiding all warp threads from the involved warp spool devices of the circular loom.

If a group of warp spool devices is provided, which is assigned to a guide device, then these warp spool devices, in relation to the direction of guiding the warp threads leading to the guide device, may be arranged next to each other, behind each other, or above each other.

If the moving guide devices are provided in the same number as the warp spool devices being operated on the circular loom, and functionally assigned to these in each case, then each warp thread will be guided separately by a guide device in each case.

By means of the movable guide device(s), the warp threads drawn from the warp thread spools can—without needing to move the warp spool devices—be brought over short distances, quickly, and with little complexity to both sides of the orbit path and hence of the track plane, where a warp thread guided by the guide device successively crosses the track plane, by the warp thread leaving the guide device for example via a thread outlet and passing through a recess in the circular orbit path assigned to the movement path of the thread outlet.

The circular orbit path therefore has a number of partially cut through or completely cut through places corresponding to the number of provided recesses.

Preferably a guide device or a thread outlet of the guide device is spatially and functionally assigned to one or more recesses in the circular orbit path. As a result, with little or ideally with no thread deflection, individual warp threads can each pass through a recess or several warp threads together can pass through a recess in the orbit path. This allows guidance and passage of the warp threads through the recess in the orbit path to take place with particularly little abrasion of the thread.

The recesses in the orbit path are preferably designed to be so narrow that only the warp thread(s) can just cross the orbit path without coming into contact with the orbit path, in order to avoid rubbing wear on the warp threads.

Preferably the recesses in the orbit path that allow the warp threads to pass through are arranged in alignment and extended in design corresponding to the alternating path of the warp threads described by the guide device(s) or rather the thread outlet of the guide device(s). This allows the warp thread to pass into the recess in the orbit path without deflection.

Specifically, the recesses in the orbit path can be designed e.g. as an elongated slot which cuts into the orbit path in a locally limited manner (partially cutting through) or e.g. as a continuous gap that interrupts and separates the orbit path at that point (completely cutting through).

While the warp threads are being moved by the guide device(s), the required thread tension on the warp threads is essentially maintained by the thread tensioning device of the warp spool devices, whose positioning can be stationary and locally variable.

In this way, the warp threads on both sides of the track plane can be e.g. alternately spread and fanned out in opposite directions, in order to form a warp thread shed while maintaining a high thread tension, while in the alternating positions of the warp threads located outside the track plane, the passage of the shuttle(s) along the orbit path is ensured, as a result of which an undulation/weaving of the warp threads with the weft thread going through the warp thread shed, which is drawn from the weft thread spool of the shuttle that is carried along the orbit path, takes place on the weaving core.

According to the sequence and the operating cycles in which the warp threads by means of the guide device(s) alternatingly change their position and the shuttles pass through the orbit path, weave patterns of all different kinds can be formed on the weaving core being woven.

Since according to the invention only the warp threads themselves are guided through the track plane by the moving guide device(s), then firstly the geometric structure of the guide device(s) for the required changing positioning of the warp threads, and the orbit path, can have a constructively simplified design, and secondly the changing positions of the warp threads can be designed to be very close to the lateral, axial boundary of the track plane, so that the passage of the shuttles is ensured just still without touching the warp thread, which means that changing the warp thread positions and the orbit of the shuttles can take place more quickly.

With the design of the circular loom according to the invention, because of a constructively and spatially reduced transport complexity for alternating and fanning out the warp threads, the weaving process can be accelerated and higher productivity achieved.

The possibility of positioning the warp threads close to the orbit path also means that the warp threads run at a very flat angle (weaving angle) relative to the extension of the track plane, with the result also because of the spatially compact change of position that the thread tension of the warp threads remains largely constant to the benefit of a high weave quality.

Furthermore, the contact-free and deflection-free guidance and passage of the warp threads through the orbit path achieves a gentle use of the warp thread material so that even delicate thread materials such as carbon fibers can be readily processed.

The result is that at a very high operating speed with high thread tension of the weft threads and the warp threads, a tightly sitting fabric of improved weave quality can be generated on the weaving core.

Because by means of the guide device(s) according to the invention only the warp threads are moved in narrow recesses in the orbit path, there results the additional advantage compared to the known design of the circular loom with the thread guide tubes pivoting into the track plane, that the movement of the shuttles in the orbit path has less vibration and therefore, while maintaining high thread tension of both the warp threads and the weft threads, it can take place more quickly and the above-mentioned productivity and quality increase is further improved.

Due to the feasibility of a stably high thread tension for the weft threads and the warp threads, the circular loom according to the invention is particularly suitable for weaving weaving cores with changing cross-sectional geometry in the axial extension (in the direction of the rotational axis of the weaving core (weaving core axis)), since the tightly woven threads can conform to the contour of a changing weaving core contour.

To weave such a contoured weaving core with a fabric remaining stationary, the weaving core is moved along the weaving axis of the circular loom so that the complete contour of the weaving core can be woven. The weaving point, at which the warp threads are woven with the weft threads on the surface of the weaving core moves not only around the circumference of the rotating weaving core but also along its weaving core axis.

The rotational axis of the weaving core (weaving core axis) is preferably designed to be congruent with the weaving axis of the circular loom so that the weaving core is moved in the direction of its rotational axis (weaving core axis) along the congruent weaving axis of the circular loom.

However, the rotational axis of the weaving core (weaving core axis) can for weaving and moving the weaving core along the weaving axis of the circular loom also be arranged at an angle to the weaving axis of the circular loom in order to be able to generate a variable angular position of the warp threads and weft threads on the weaving core and hence a changing thread tension.

Due to the advantages described above, the circular loom according to the invention is also suitable for the production of hollow-profile, fibrous woven preforms of fiber composite products e.g. for the production of woven preforms for wheel rims made of fiber composite materials.

Advantageous designs and further developments of the invention arise from the dependent patent claims, the following description, and the associated drawings.

According to an advantageous design, the moving guide device has at least one movably or pivotably arranged or designed positioning part.

The positioning part can be moved or pivoted in an alternating manner by means of appropriate constructive design of the guide device relative to a base body of the guide device or relative to the machine housing of the circular loom or relative to the circular orbit path.

The guide device and/or the positioning part can preferably be equipped with at least one thread guide element.

The thread guide element of the guide device is provided for the actual steering and guiding of at least one warp thread in its alternating movement, and it guides with it a warp thread or several threads being drawn from the warp thread spool(s), if necessary also with a thread deflector.

The thread guide element can be connected to the positioning part or be designed so that it is integrated into the positioning part.

One or more thread guide element(s) can be arranged or designed on the positioning part of the guide device.

The warp thread can also be guided and positioned by a guide device positioning part that directly carries a warp thread spool, as a result of which a thread guide element may be unnecessary.

The guide device may also have several positioning parts, possibly with one or more thread guide elements for guiding and steering in each case one or more warp threads.

Preferably according to a constructively favourable embodiment the thread guide element is designed as a thread guide channel, a thread guide groove, or as a thread guide eye, through which in each case the warp thread is passed.

The thread guide element can end with a thread outlet for the warp thread. An outlet opening at the exit of the guided warp thread from the thread guide element of the positioning part is referred to as a thread outlet.

Preferably the thread guide element for moving or pivoting the warp thread can be arranged and designed on or in a movably or pivotably mounted positioning part of the guide device.

The positioning part of the guide device may for example be a movable guide carriage or a swivel arm, on or in which one or more thread guide element(s) are arranged or designed.

In addition, the positioning part can also be a movable or pivotable roller, on which a thread guide groove is formed as a thread guide element, through which the warp thread runs in a guided manner.

Preferably the movement or pivoting of the positioning part and also of the guided warp thread with or without thread guide elements takes place parallel to the weaving axis or with the rotary axis perpendicular to the weaving axis of the circular loom.

This results in the thread guide path of the warp threads being essentially perpendicular to the track plane of the orbit path.

If the recesses in the orbit path are designed also to correspond to the movement path of the warp threads during their alternating movement, i.e. are also parallel to the weaving axis of the circular loom, then the path and travel time of the warp threads to cross the track plane can be shortened, with the result that the alternating speed of the warp threads and hence the circular speed of the shuttles can be increased.

According to a further advantageous design, the positioning part is designed to be linearly movable, as of result of which consequently the guided warp thread is also linearly movable.

Linear movability of the positioning part can be implemented relatively simply constructively and in terms of control technology.

In terms of drive technology, direct drives, preferably linear drives, can be used. These can be located e.g. on the positioning part, on the base body or on the machine housing and for example can be operated pneumatically by pneumatic cylinders or electrically by electric motors, whereby each positioning part can be driven individually.

The alternating movement of the positioning part can be generated and controlled by means of special switchable direct drives that act in two directions, e.g. by means of a rack or threaded rod.

These drives can achieve powerful acceleration, braking and quick switching in operation and hence effect a rapid change in direction of the positioning part.

The guidance and/or the drive of the positioning part can also be designed to be magnetic and/or electromagnetic.

Furthermore, if the warp thread carried with the positioning part is also moved linearly, the associated linear movement of the warp thread also results in lower thread tension losses than in non-linear movements of the warp threads, which further improves the quality of the woven product.

Preferably the linear movability of the positioning part and of the guided warp thread is in an axial direction along the weaving axis of the circular loom.

In addition to the space saving that results from this, the path of the positioning part and hence the path of the warp thread is exactly perpendicular to the track plane of the orbit path.

This means that the path and travel time of the warp threads for crossing the track plane can be shortened in a straight line with as few deflections as possible, with the result that the alternating speed of the warp threads and hence the circular speed of the shuttles can be further increased.

The positioning part of the guide device can for example be mounted movably or pivotably by means of corresponding bearing elements.

Thus, for example, a guide carriage can be movably mounted on a base body of the guide device or on a component of the machine housing or directly on the outer circumference of the circular orbit path by means of suitable moving bearing elements, while a swivel arm can be pivotably mounted on a base body of the guide device or on a component of the machine housing or directly on the outer circumference of the circular orbit path by means of suitable pivoting support elements.

Similarly, the base body of the guide device can be arranged on a component of the machine housing or directly on the outer circumference of the circular orbit path.

The base body can be joined stationarily to or arranged movably on the machine housing or orbit path.

One or more positioning parts can be assigned to a base body, which are movably or pivotably mounted relative to this base body.

The bearing element(s) for the movable mounting of a positioning part, e.g. a guide carriage, can be for example one or more longitudinally extended guide groove(s) of the base body or of the component of the machine housing or of the guide carriage, which are arranged in the direction of the intended movement axis of the thread guide element and correspond to suitable guide pins or guide bar(s) of the guide carriage or of the base body or of the component of the machine housing.

In particular, corresponding bearing elements in a dovetail form (tongue and groove) may be provided.

Furthermore the bearing elements can also be one or more guide rail(s) corresponding with rollers or bearing bushes.

The corresponding bearing elements are preferably designed so that they slide or roll onto or off each other with as little frictional resistance as possible so that the positioning part can be moved or pivoted and accelerated as easily and quickly as possible.

In such cases, it is advantageous if the positioning part also has as low a mass as possible. In this regard, the material for the positioning part is preferably plastic or a light metal.

Several bearing elements such as longitudinally extended guide grooves, guide bars or guide rails can be arranged parallel to each other, which makes the bearing and guidance of the guide carriage and hence the guidance of the warp threads even more accurate and certain.

The bearing elements for bearing a guide carriage can be designed in accordance with known linear guides, such as linear guides made by Festo.

If a base body is provided that is arranged in the radial direction between the positioning part and the circular orbit path, then this is preferably designed and in relation to the warp thread carried by the positioning part arranged in such a way as to enable the contactless passage of the guided warp thread through the base body in the direction of the circular orbit path.

For example, the base body can have a slot-like pass-through opening assigned to the thread guide or rather to the path of the thread outlet so that the warp thread, preferably without touching the pass-through opening, can run through it.

If according to another advantageous design the warp thread spool of at least one warp spool device is essentially arranged in a straight and hence deflection-free extension of the running path of the warp thread through the thread guide element and/or essentially in a straight and hence deflection-free extension of the moving or swivelling path of the thread guide element, the design may result in an advantageous reduction of the total required thread deflections and a reduction in frictional wear in the movement path of the warp thread between the warp thread spool of the warp spool device and its passage through the thread guide elements of the guide device.

In particular, this allows firstly the thread tension of the warp threads concerned to be kept even more stable with lower thread tension losses, and secondly the thread guidance can be implemented in a way that is particularly gentle on the threads.

In particular as a result of a stable thread tension and gentle guidance of the weft and warp threads, the greatest possible variety of thread, ribbon or fiber materials in various fiber thicknesses and combinations thereof can be used, for example delicate carbon fibers, but also broad flat ribbons or other textile skeins.

According to another advantageous design, the warp thread spool of at least one warp spool device is arranged essentially in a lengthening of the radial extent of the circular orbit path. As a result, in particular the warp thread spool(s) of the warp spool device(s) are arranged not only outside of the circumference of the circular orbit path but also essentially in a radial lengthening of the orbit path or rather of the track plane.

The warp thread spools of several warp spool devices can be arranged in a radial, star-shaped arrangement around the outer circumference of the circular orbit path.

The warp spool device(s) can be fastened e.g. to a radial outer wall of the machine housing of the circular loom.

In this arrangement, the warp threads can run with very little deflection from the warp thread spool via the guide device(s) to the weaving point.

The thread deflections of the warp threads to be performed by the alternating back-and-forth movement of the guide device(s) are largely reduced and at the same time the thread length of the warp thread is subject to fewer fluctuations, which makes a further advantageous contribution to a constant thread tension.

A particularly advantageous design of the invention envisages that at least one warp spool device is arranged on the movable guide device.

In this case, the warp spool device(s) is/are carried with the warp thread spool by means of the guide device, preferably by the moving positioning part.

Preferably the warp spool device can be carried piggy-back-style by the moving guide device.

For example, the warp spool device(s) can be arranged and carried on the positioning part(s) of the guide device(s), where one or more warp spool devices can be provided on one positioning part.

In the design of the invention, greater compactness of the circular loom can be achieved and to the advantage of further improved thread tension and thread protection the path of the warp thread can be further shortened and the number of required deflections in the thread guidance of the warp thread can be minimised, particularly since as a result of the direct assignment of the warp spool device to the guide device the thread tension can be kept stable explicitly for the individual warp thread.

If two or more warp spool devices are arranged on a movable guide device, then these warp spool devices are moved with their warp spools together with the guide device.

If several warp spool devices are carried, several warp threads of the warp spool devices can be guided together or individually by preferably one thread guide element and further together or individually pass through a recess in the orbit path.

These combinations enable the joint guiding and weaving of several, even different kinds of warp threads, particularly while ensuring an essentially consistent high thread tension of the warp threads.

According to a constructively favourable design of the invention, the circular orbit path has at least one guide rail or is formed by at least one guide rail, in or on which at least one shuttle is guided.

In this case, the shuttle/shuttles can orbit by rolling or sliding means in or on at least one preferably ring-shaped guide rail, which defines the circular orbit path.

The guide rail, corresponding to the formation of the recesses at which the warp thread or the warp threads before or after the passage of the shuttle alternately pass through the track plane and hence cross the passage path of the shuttles, is locally cut partially through for example by slots, or completely cut through by continuous gaps. In the case of e.g. interruptions in the rail formed by gaps, the guide rail is divided into rail segments.

The shuttle(s) move, roll, slide over these partially or completely cut through places in the ring-shaped guide rail.

The partially or completely cut through places in the ring-shaped guide rail are preferably designed to be so narrow that only the warp thread(s) can just cross the guide rail, without touching it, in order to prevent rubbing abrasion on the warp threads. Accordingly, the very narrow partially or completely cut through places in the ring-shaped guide rail have almost no effect on the passage and hence on the smooth running of the shuttles.

To improve the running accuracy, the shuttle or shuttles can also orbit by rolling or sliding means on several guide rails that are arranged spaced apart.

The alternating positions of the warp threads can preferably be designed to be so close to the axial boundary of the ring-shaped guide rail that the passage of the shuttle without touching is only just ensured.

The guide rail is preferably designed as an internal-runner rail, in which the shuttle(s) orbit within the circular orbit path which radially delimits the track plane.

It is also possible to conceive a design where the shuttle(s) are arranged in an integrated manner within several guide rails that are arranged spaced apart.

The guide rail(s) in all cases provide a track that enables a low-vibration orbit of the shuttles with consistently high thread tension of the weft threads, as a result of which a largely homogeneous weaving operation at a simultaneously high circular speed is achievable.

The shuttle can for example be guided by means of rollers, preferably by means of rubberised rollers, in or on the guide rail and roll over the partially and completely cut through places, which further improves the smooth running of the shuttle in respect of vibrations and roller noise.

According to a further advantageous embodiment of the invention, the guiding and/or the drive of the shuttle on or in the circular orbit path is designed magnetically and/or electromagnetically, e.g. similarly to a known Transrapid propulsion system. In this case, e.g. on the circular orbit path, a wandering electromagnetic field can be generated so that the shuttle by means of a magnetic bearing and/or electromagnetic steering is guided and/or driven rolling, sliding or floating contactlessly along the electromagnetic field and hence along the circular orbit path.

In this way, in particular the frictional resistances in the orbit of the shuttles along the circular orbit path and over the interruptions can be further reduced.

According to a particularly advantageous embodiment of the invention, a second circular orbit path can be provided, along which in each case at least one shuttle is movable, where the guided warp thread, crossing the track plane of the first and/or second orbit path, passes through the recess of the first and/or second circular orbit path.

In this case, the guided warp threads can be moved alternatingly and following any sequence pattern by means of the guide device assigned to the two orbit paths, crossing one or both track planes.

As a result of combining the circular orbit paths with each other, parallel operation of several shuttles with different circulation directions and circulation cycles as well as various thread, ribbon or fiber materials is possible, as a result of which a large number of different weft threads and warp threads can be processed simultaneously and an even greater variety of possible weave patterns and fabric characteristics can be created.

Preferably the second circular orbit path can be arranged at a parallel spacing from the first circular orbit path.

These and further features arising from the patent claims, the description of the example embodiments and the drawings can in each case be realised by themselves or in combination as advantageous embodiments of the invention for which protection is claimed here.

BRIEF DESCRIPTION OF THE DRAWINGS

The circular loom according to the invention is explained in greater detail below with several example embodiments. The associated drawings show in a schematic representation in FIG. 1*a* front view of a circular loom according to the invention for weaving a contoured, two-part weaving core with a variable core cross-section, with a rail-guided circular orbit path for two shuttles and with 12 stationary warp spool devices and 12 guide devices, FIGS. 2*a,b* side views of the circular loom according to FIG. 1 (from the right) in two operating phases of weaving the contoured, two-part weaving core with variable core cross-section, FIG. 3 a front view of a second design of the circular loom according to the invention for weaving a cylindrical weaving core, with a rail-guided circular orbit path for two shuttles and with 12 stationary warp spool devices and 12 guide devices, FIG. 4 a half-sided side view of the circular loom according to FIG. 3, FIG. 5 a half-sided side view of the circular loom according to FIG. 3, however with 24 stationary warp spool devices and 12 guide devices, FIG. 6 a front view of a third design of the circular loom according to the invention for weaving a cylindrical weaving core, with a rail-guided circular orbit path for two shuttles and with 12 warp spool devices on 12 guide devices, FIGS. 7*a,b* side views of the circular loom according to FIG. 6 in two working phases of weaving the cylindrical weaving core, FIGS. 8*a,b,c* half-sided side views of a fourth design of the circular loom according to the invention, similar to the circular loom according to FIG. 6 with two rail-guided circular orbit paths for in each case two shuttles and with 12 warp spool devices on 12 guide devices in three working phases of weaving a cylindrical weaving core, FIGS. 9*a,b,c* half-sided side views of a fifth design of the circular loom according to the invention, similar to the circular loom according to FIG. 8 with two rail-guided circular orbit paths for in each case two shuttles and with 24 warp spool devices on 12 guide devices with in each case two guide carriages in three working phases of weaving a cylindrical weaving core FIGS. 10*a,b* side views of a sixth design of the circular loom according to the invention for weaving a contoured, two-part weaving core, with a rail-guided circular orbit path for two shuttles and with 12 stationary warp spool devices and 12 alternative guide devices in two working phases.

DETAILED DESCRIPTION OF EXEMPLARY EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

In the examples explained below, reference is made to the accompanying drawings, which form part of the examples and in which specific embodiments in which the invention can be put into practice are shown for illustrative purposes.

Identical, equivalent or similarly designed elements are assigned identical reference symbols where appropriate.

It is to be understood that other embodiments can be used and structural or logical changes made without departing from the protective scope of the present invention.

It is to be understood that the characteristics of the various designs described herein can be combined with each other unless specified to the contrary. The following detailed description should therefore not be understood in a restrictive sense.

The scope of protection of the present invention is defined by the attached claims.

Figure 1:
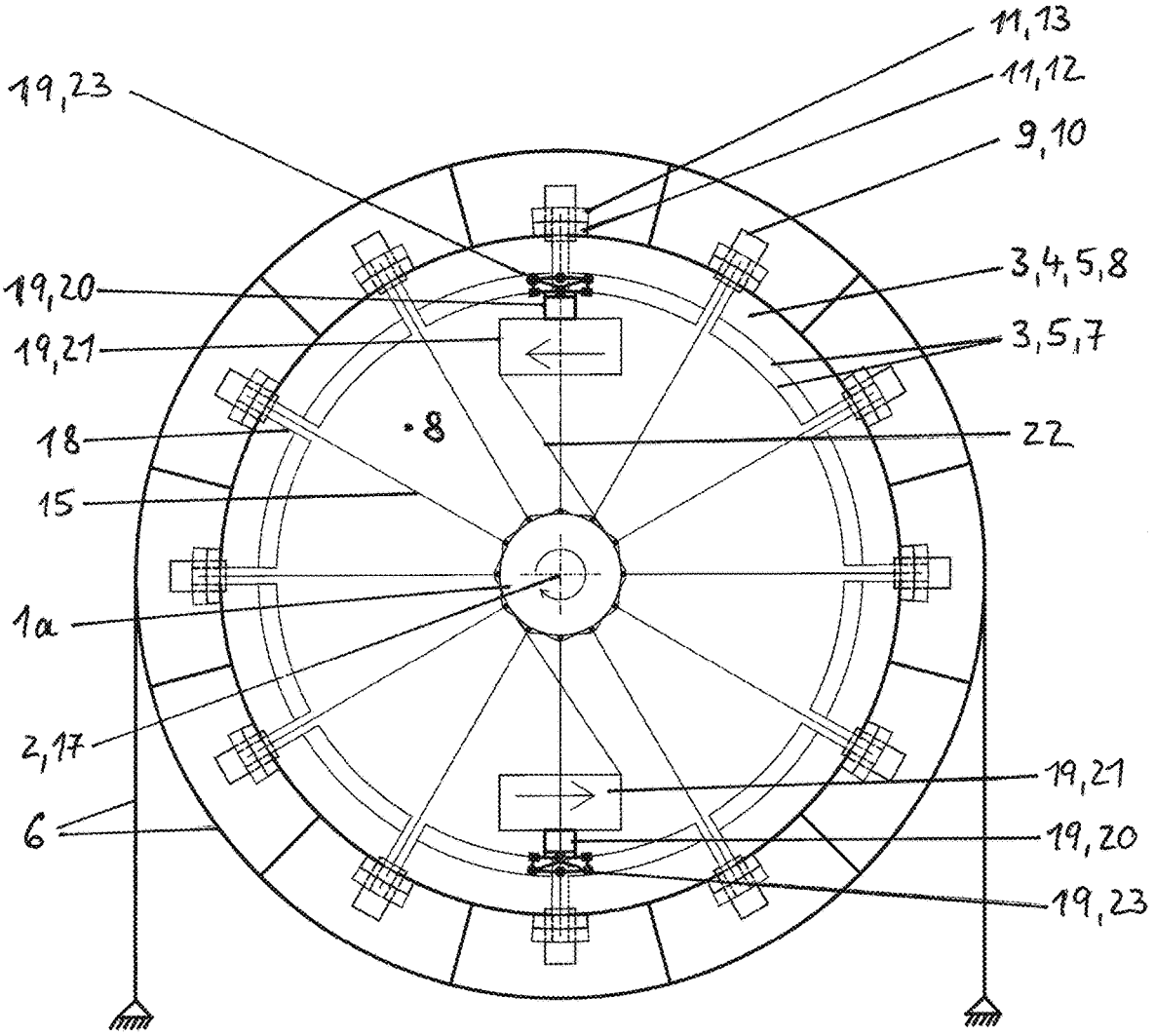

FIG. 1 shows a circular loom, in which a weaving core 1*a* is arranged centrically to a weaving axis 2 of the circular loom and is surrounded by a circular orbit path 3 of the circular loom. The orbit path 3 has a ring-shaped track body 4 comprising 12 track segments 5 arranged one after the other, designed in a ring segment shape, which are arranged fixed relative to the housing on a preferably hollow cylindrical machine housing 6 of the circular loom. The track body 4, explicitly the track segments 5, each have three rail pairs of guide rails 7 running in a ring segment shape, where the rail segment pairs (rail pairs) of the track segments 5 arranged one after the other are arranged and designed concentrically circling around the central weaving axis 2 of the circular loom.

Figure 2A:
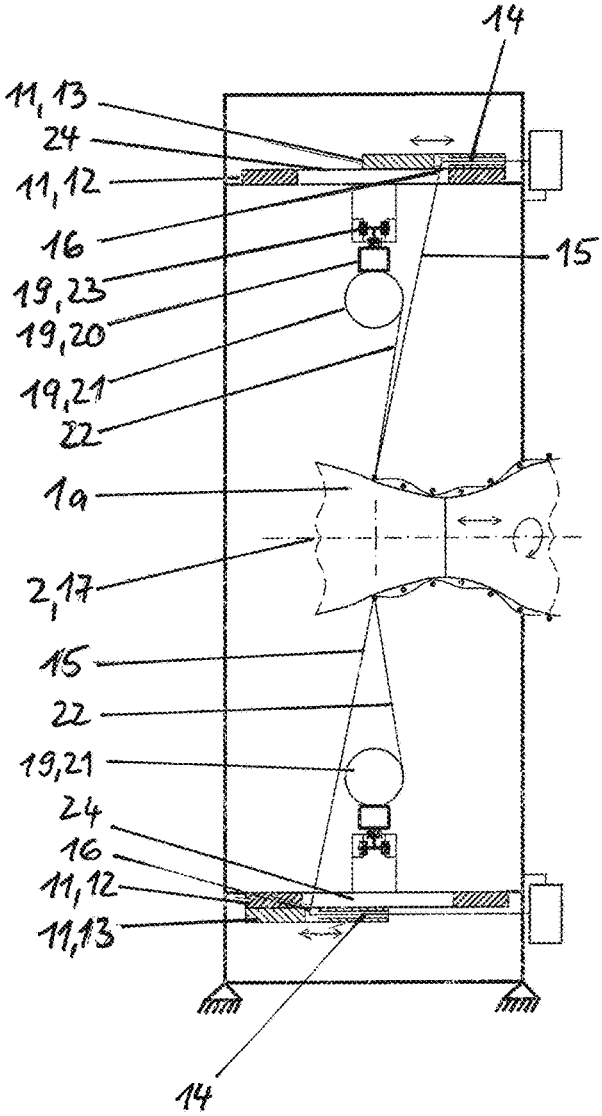

Two outer rail pairs each with two guide rails 7 are each arranged on the opposite side walls of the track segments 5 of the track body 4 and an inner rail pair, in each case with two guide rails 7 is arranged in each case on an axially extended inner wall of the track segments 5 facing towards the weaving axis 2 (see also FIGS. 2*a, b*).

The radially outer boundary of the track body 4 is formed by the axially extended outer walls of the track segments 5 facing away from the weaving axis 2, while the radially extended side walls of the track segments 5 axially delimit the track body 4.

The segmented track body 4 together with the segmented guide rails 7 (rail segment pairs) forms the circular orbit path 3, where the outer boundary of the track body 4 in its radial and axial extension defines the outer contour of a track plane 8 of the circular orbit path 3.

The circular loom further has 12 warp spool devices 9 each with 12 warp thread spools 10, which are arranged fixed relative to the housing laterally on the machine housing 6 of the circular loom.

Corresponding to the number of available warp spool devices 9, on the outer circumference of the track body 4 a total of 12 movable, mobile guide devices 11 are arranged outside the circular orbit path 3 and concentrically around the central weaving axis 2 of the circular loom.

Each of the guide devices 11 has a base body 12 that is fixed to the track body 4 and/or the machine housing 6 and a positioning part 13 that is axially movable relative to the base body 12 and the machine housing 6, which in the example embodiment is designed as a guide carriage 13.

The guide carriage 13 contains a thread guide element 14 for guiding and steering a warp thread 15, which in this example embodiment is designed as an axially directed thread guide channel 14 (thread channel) and ends with a thread deflector in a thread outlet 16.

Here the thread guide element 14 can also be designed as a thread guide groove that is open on top (not shown).

The weaving core 1*a* has a weaving core axis 17 which according to the arrangement in this example embodiment runs congruently with the weaving axis 2 of the circular loom. As can be clearly seen from the side view according to FIGS. 2*a, b*, the separable weaving core 1*a* is designed with a variable core cross-section and hence with a non-uniform circumference. It is mounted rotatably around its weaving core axis 17 and movably along the weaving axis 2 of the circular loom.

FIGS. 1, 2*a* and *b* show that the warp threads 15 of the 12 warp thread spools 10 for weaving the weaving core 1*a* while maintaining a certain thread tension of a not shown thread tensioner of the warp spool device 9 are guided in each case via a thread channel 14 and a thread outlet 16 of the mobile guide carriage 13 of the guide device 11 to in each case a weaving point on the weaving core 1*a*.

In accordance with the number of guided warp threads 15, the orbit path 3, or rather the track body 4 and the guide rails 7 have recesses 18 in the form of narrow gaps 18 going through them that are perpendicularly aligned with the weaving axis 2, which divide the track body 4 with the guide rails 7 into the 12 track segments 5.

Along the guide rails 7 two shuttles 19 are guided, each of which has a shuttle carriage 20 with in each case a weft thread spool 21.

The weft thread 22 of the weft thread spool 21 is guided to weave the non-uniformly contoured weaving core 1*a* while maintaining a certain thread tension linearly to the current weaving point on the weaving core 1*a*.

The shuttles 19 run by means of the shuttle carriages 20 along the guide rails 7, which form the guide for the orbiting shuttles 19 and thus determine the circular movement path of the shuttles 19.

The rotary axis of the weft thread spool 21 is arranged in the orbit direction of the shuttle 19 so that the feeding of the weft threads 22 to the weaving core 1*a* is achieved largely with few deflections or without deflections.

The shuttle carriages 20 each have nine rubberised guide rollers 23, of which in each case three guide rollers 23 are assigned to a rail pair of the guide rails 7. In each case three guide rollers 23 are held and guided on both sides by the two outer rail pairs of the guide rails 7 and three additional rollers 23 are guided on both sides by the inner rail pair of the guide rails 7.

Each shuttle 19 can be driven and controlled separately by means of a motor (direct drive) located on the shuttle carriage 20, where the power supply can be provided e.g. via several sliding contacts or onboard energy stores, and the control commands can be transmitted e.g. via radio control signals (not shown).

The shuttles 19 can therefore roll independently of each other at the same or different speeds along the guide rails 7 of the orbit path 3.

The guide rollers 23 are designed in such a large number and spaced so far apart from each other that the shuttle carriage 20 during its orbit always makes contact with at least two track segments 5 and hence can bridge one or even several gaps 18 in the track body 4 at the same time, ensuring smooth and quiet running of the shuttle carriages 20.

In FIGS. 1, 2*a, b* both orbiting shuttle carriages 20 of the shuttles 19 are shown schematically in the 6 o'clock and 12 o'clock position along the orbit path 3 respectively.

For the sake of clarity, FIGS. 2*a, b* in each case show only two warp spool devices 9 and the associated guide devices 11, namely the warp spool devices 9 and guide devices 11 arranged in the 6 o'clock and 12 o'clock position of the circular loom.

The warp thread 15 provided from the warp spool device 9 is guided through the thread channel 14 and emerges at a thread outlet 16 of the guide carriage 13, from where the warp thread 15—running through an axially extended passage 24 of the base body 12 without touching—is guided linearly to the weaving point on weaving core 1*a*.

The thread channel 14 in relation to the circular loom and its orbit path 3 is aligned axially in the direction of the weaving axis 2 with the result that the warp thread 15 runs essentially perpendicular to the track plane 8 through the thread channel 14.

The guide carriages 13 arranged around the circumference of the orbit path 3 are in each case mounted linearly slidably relative to each other in the axial direction parallel to the weaving axis 2.

To mount the guide carriage 13, on the base body 12 two longitudinally extended guide grooves arranged parallel to each other are provided, in which the guide carriage 13 is slidably mounted and guided with two corresponding guide bars (not shown).

The guide grooves and guide bars in relation to the circular loom and its orbit path 3 are aligned axially aligned in the direction of the weaving axis 2, with the result that the guide carriages 13 with the thread channel 14 and the carried warp threads 15 in each case can be moved essentially perpendicularly to the track plane 8 of the orbit path 3 and parallel to the weaving axis 2.

The fast alternating movement of the guide carriages 13 is generated and controlled via individual, switchable electric linear drives, acting in two directions (not shown).

Control of the back-and-forth movement of the guide carriage 13 can be realised e.g. along a rack or threaded rod (not shown).

In this example embodiment, the warp thread spools 10 of the warp spool devices 9 are in each case arranged in a straight-line extension of the thread channel 14 of the guide carriage 13 on the machine housing 6.

The feeding of the warp threads 15 from the warp thread spools 10 via the thread channel 14 of the guide carriage 13 on to the weaving point on weaving core 1*a* thus largely takes place in a straight line with few deflections, whereby the thread tension of the warp threads 15 can be maintained at a high level.

For the alternating changeover of the warp threads 15 on both sides of the track plane 8, the warp threads are in each case guided linearly back and forth in the axial direction by means of the movable guide carriage 13, as a result of which the warp thread 15 emerging from the thread outlet 16 passes through an axially extended passage 24 in the base body 12 (see FIG. 2*a, b*) and then passes through the corresponding axially extended narrow gaps 18 between two adjacent track segments 5 and crosses the track plane 8 (see FIG. 1).

Because of these narrow gaps 18, only the warp threads 15 pass through the orbit path 3 in both directions without touching, for the purpose of changing sides.

The warp threads 15 running to the weaving point, as they are alternatingly guided back and forth, assume a changing angle (weaving angle) with respect to the extension of the track plane 8. When passing through the gap 18 in the orbit path 3, the weaving angle of the warp threads 15 is approximately 0°, and in the change position to ensure the passage of the shuttle 19, the maximum weaving angle of the warp threads 15 is reached (see FIG. 2*a, b*).

Since during the necessary change of sides of the warp threads 15, apart from the warp threads 15 themselves there are no geometric elements acting in the area of the orbit path 3 or in the track plane 8, the shuttles 19 alone form the outer boundary for the positioning of the warp threads 15 during the passage of the shuttles 19, with the result that the warp threads 15 can form an optimally small maximum weaving angle, which results during the position change of the warp threads 15 in a small angle change of the weaving angle of the warp threads 15 relative to the track plane 8.

This angle limitation of the movement of the warp threads 15 for the change of sides additionally ensures the maintenance of a high thread tension of the warp threads 15.

The straight-line guiding of the guide carriages 13 of the guide device 11 perpendicularly to the track plane 8 also enables very short paths for conveying the warp threads 15 and consequently in conjunction with the above-mentioned rapidly acting linear drives of the guide carriages 13 it enables a particularly effective alternating of the warp threads 15 on both sides of the track plane 8.

FIG. 2*a, b* show two operating phases of the weaving process in the circular loom with alternating positioning of the guide carriages 11 with the warp threads 15 while both shuttles 19 travel around their orbit in each case by 180°.

In the operating phase according to FIG. 2*a*, the two orbiting shuttles 19 are in the 6 o'clock and 12 o'clock position of the circular loom, while some of the guide carriages 13, including the guide carriage 13 of the guide device 11 arranged in the 12 o'clock position, with the warp thread 15 are located in the image plane to the right of the orbit path 3 and other guide carriages 13, including the guide carriage 13 of the guide device 11 arranged in the 6 o'clock position, with the warp thread 15 are located in the image plane to the left of the orbit path 3, with the result that the space for the passage of the shuttles 19 at the 6 o'clock and 12 o'clock position is cleared by the warp threads 15 which are spread out away from the track plane 8 forming a shed.

However, an arbitrary number of guide carriages 13, for example every second, third or all guide carriages 13 of the guide devices 11 can be located in the image plane to the right or left of the orbit path 3 during an orbit of the shuttle 19.

Figure 2B:
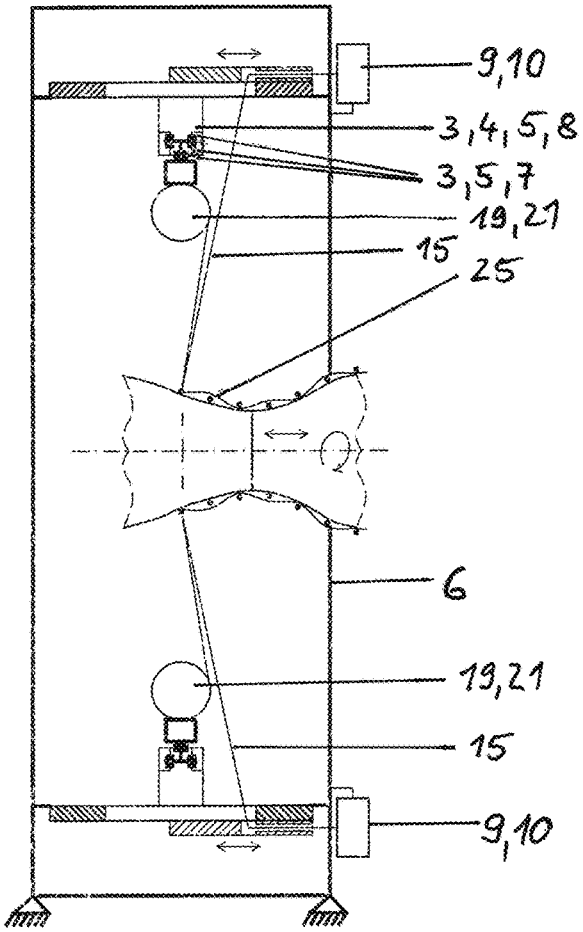

FIG. 2*b* shows the operating phase of the circular loom in which the shuttle 19 that was previously in the 6 o'clock position is passing the 12 o'clock position and vice versa, while some guide carriages 13, including the guide carriage 13 of the guide devices 11 arranged in the 6 o'clock and 12 o'clock position, with the warp thread 15 are located in the image plane to the right of the orbit path 3, while the shuttles 19 pass through the 6 o'clock and 12 o'clock position.

However, here too an arbitrary number of guide carriages 13, for example every second, third or all guide carriages 13 of the 12 guide devices 11 can be located in the image plane to the right or left of the orbit path 3.

Furthermore, the shuttles 19 may circulate at symmetrical or asymmetrical intervals from each other on the guide rails 7.

The warp threads 15 are spread out alternately in opposite directions in the above-described mode or in another alternating mode of the guide carriages 13, the result of which is to produce an undulation of the warp threads 15 with the weft threads 22 of the shuttles 19 orbiting in a particular mode on the orbit path 3, to generate a hollow-profile-like fabric 25 with the desired weave pattern, as shown in FIG. 2*a, b*.

During the weaving process, the non-uniformly profiled weaving core 1*a* can be axially moved along the weaving axis 2, with the fabric 25 being set down in a fixed/stationary manner on the weaving core 1*a*. Depending on the desired weaving result, the axial movement of the weaving core 1*a* can take place for example quasi-stationarily, discontinuously, or continuously. A forwards and backwards movement of the weaving core 1*a* to generate several fabric layers 25 is also possible.

During its axial movement, the weaving core 1*a* can additionally be moved in rotation around its weaving core axis 17 or be tilted relative to the weaving axis 2 in order to generate a changed angular position of the warp threads 15 and the weft threads 22 of e.g. +/−60° to the weaving core axis 17 on the weaving core 1*a*.

The uniform weaving structure shown in FIG. 2*a, b* resulting from a uniform weaving mode can be changed by means of the individual drive and the controlling of both the shuttle carriages 20 and the guide carriages 13 as well as the weaving core 1*a*, also during the weaving process.

The shuttle carriages 20 can orbit very precisely and evenly by means of the guide rails 7 and at the same time apply a high thread tension to the carried weft thread 22.

The narrow gaps 18 in the orbit path 3 for the passage of the warp threads 15 can be easily rolled over by means of the large number of widely spaced, rubberised guide rollers and largely without influencing the shuttle carriage 20, with the result that the smooth orbit of the shuttles 19 is not impaired.

The fast, alternating spreading of the warp threads 15 by means of the guide carriages 13 that are operable over short distances furthermore enables the running speed of the shuttles 19 orbiting on the guide rails 7 to be increased.

Once the weaving core 1*a* has been woven it can be removed sideways out of the circular loom and another weaving core to be woven can be fitted into the circular loom.

The stated advantages of the circular loom result in high process efficiency and also enable the weaving of the weaving core 1*a* with a very tightly and firmly woven fabric 25.

For this reason, the circular loom is particularly suitable also for weaving large, non-uniformly contoured weaving cores with contour-conforming technical fabrics, e.g. for manufacturing woven hollow-profile fiber preforms for wheel rims.

Figure 3:
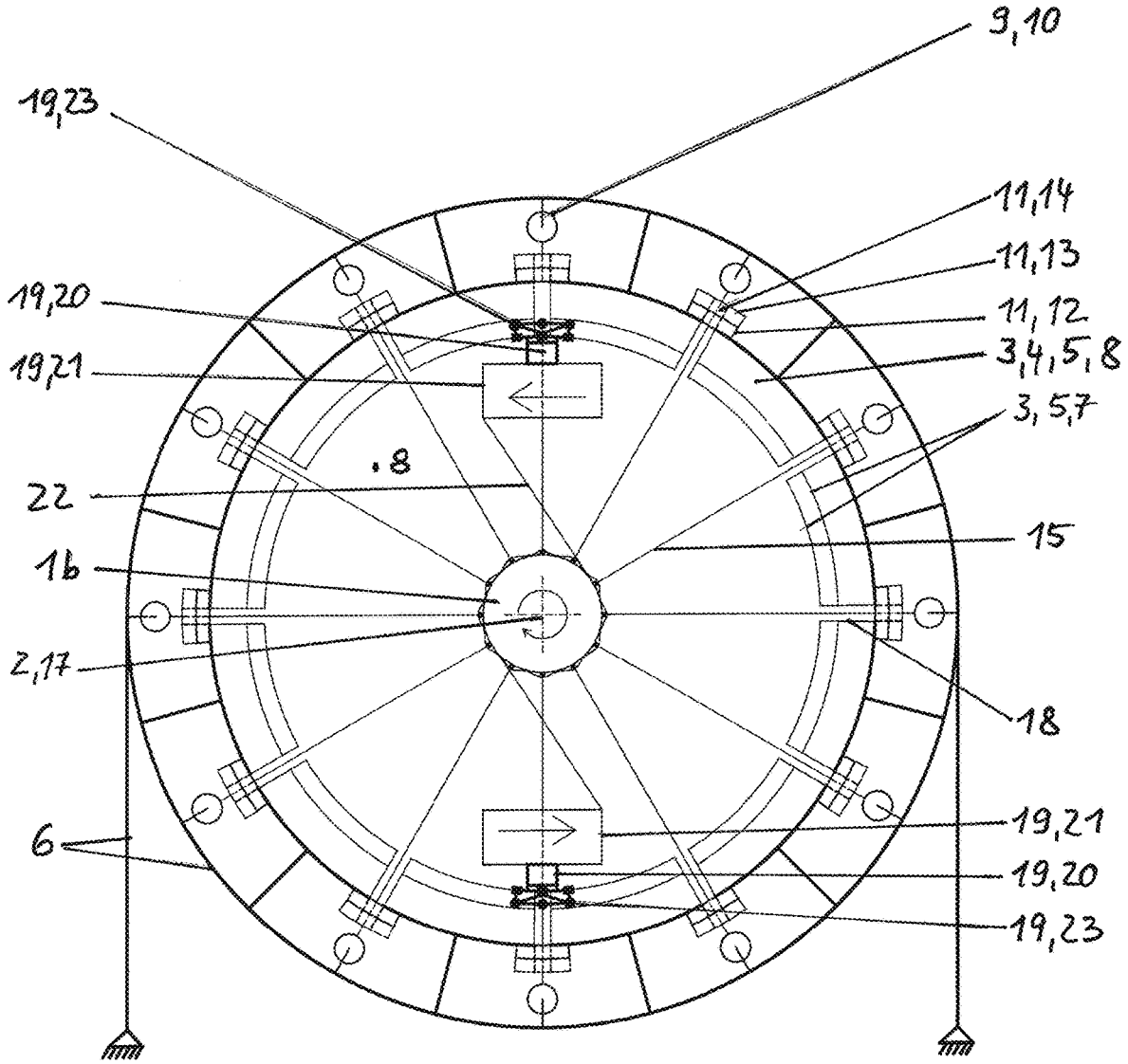
Figure 5:
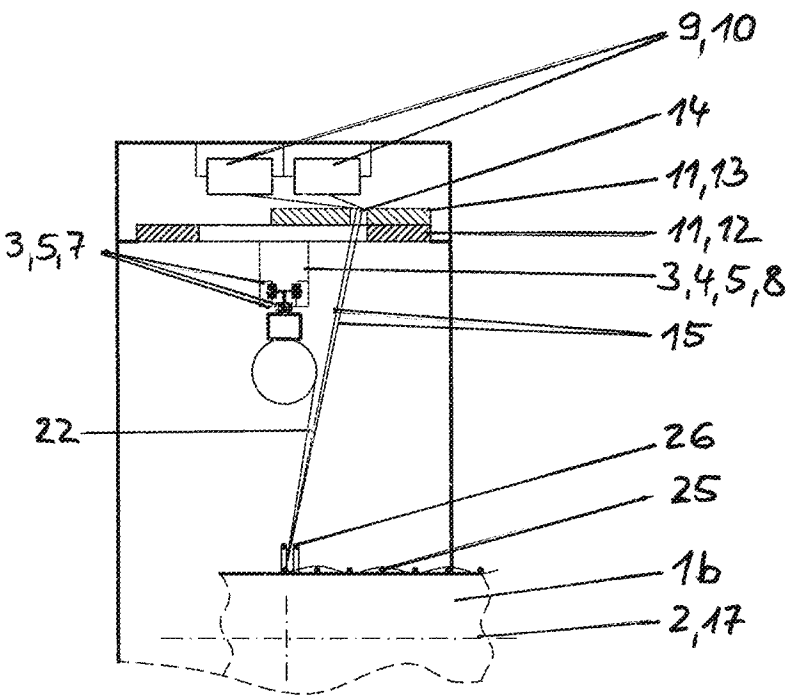
Figure 4:
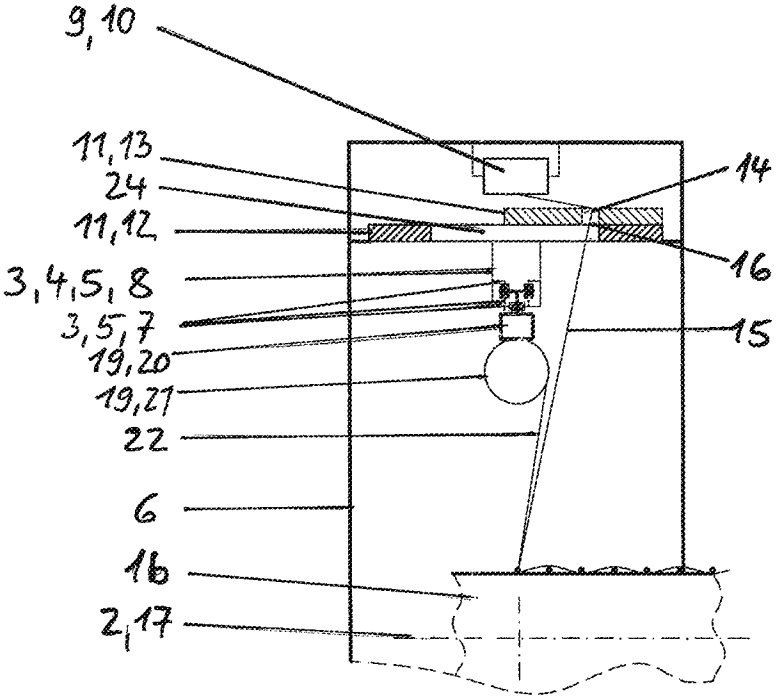

FIGS. 3, 4, 5 show a second design of the circular loom according to the invention, in this case for weaving a cylindrical weaving core 1*b*.

The above description for the first design of the circular loom also applies in respect of the matching features and their advantages to the circular loom described here according to the second design, with the result that in this regard reference is made to the corresponding statements.

To avoid repetition, only the differences compared to the first design of the circular loom according to FIGS. 1, 2*a, b* are described below.

In this design, the warp spool devices 9 are arranged fixed relative to the housing essentially in a lengthening of the radial extent of the circular orbit path 3 on an outer wall of the machine housing 6 of the circular loom.

The 12 warp spool devices 9 provided according to FIG. 3 and FIG. 4 are arranged essentially centrally in an extension of the track plane 8 of the orbit path 3.

The 24 warp spool devices 9 provided according to FIG. 5 are arranged in pairs next to each other in the axial direction, with the mirror line of a pair of the warp spool devices 9 being arranged essentially centrally in an extension of the track plane 8.

The 12 warp spool devices 9 according to FIG. 3 and FIG. 4 are in each case assigned to a moving, mobile guide device 11 with the result that one warp thread 15 is guided per guide device 11.

The 24 warp spool devices 9 according to FIG. 5 are in each case assigned in pairs to a moving, mobile guide device 11 with the result that two warp threads 15 are guided per guide device 11.

For the sake of clarity, FIG. 4 and FIG. 5 in each case show and describe further only the warp spool devices 9 and associated guide devices 11 in the 12 o'clock position of the circular loom.

The guide carriage 13 of the guide device 11 according to FIG. 4 and FIG. 5 has in each case a thread guide element 14 with a radially directed thread channel 14, followed by the thread outlet 16. The warp threads 15 provided by the warp spool device 9 according to FIG. 4 run individually in each case through a radially directed thread channel 14 of a guide carriage 13 and the warp threads 15 provided by the warp spool device 9 according to FIG. 5 run pairwise in each case through a radially directed thread channel 15 of a guide carriage 13.

During the alternating sideways movement of the guide carriage 13 to change the warp thread positions, the radially directed thread channel 14 with the warp thread 15 or both warp threads 15 is alternately in a position to the right and left of the orbit path 3 and track plane 8.

During the sideways motion, momentary intermediate positions of the thread channel 14 occur, e.g. a central position, in which the radially directed thread channel 14 is located essentially in a straight-line extension to the fixed arrangement relative to the housing of the warp thread spool 10 of the warp spool device 9 and therefore temporarily enables a deflection-free path of the warp thread 15 through the thread channel 14.

With this specific guiding of the warp thread/warp threads 15 the necessary thread deflections and absolute thread length of the warp threads 15 are reduced and in particular also the different relative thread lengths that result during the sideways movement of the guide carriages 14 are minimised, which further improves the maintenance of the thread tension of the warp threads 15.

With the circular loom design according to FIGS. 3 to 5, by way of example the weaving of a weaving core 1*b* with a uniform, cylindrical core cross-section is intended.

When weaving the cylindrical weaving core 1*b* this can for example be stationarily fixed during the weaving process, with the fabric 25 being continuously pulled off the weaving core in an axial direction along the weaving axis 2 of the circular loom or rather along the weaving core axis 17 of the weaving core 1*b*. Preferably the weaving core 1*b* in this case is aligned with the weaving axis 2 in a congruent axial position.

In the design according to FIG. 5 furthermore by way of example a weaving ring 26 fixed relative to the housing is arranged concentrically spaced around the weaving core 1*b*, which additionally homogenises the feeding of the warp threads 15 and weft threads 22 to the weaving point, by damping their thread vibrations and compensating for their thread tension fluctuations, which has an advantageous effect in particular on circular looms having an orbit path 3 of larger diameter and which therefore have larger distances from the weft thread spool 21 and the thread outlets 16 of the thread guide elements 14 of the guide devices 11 to the weaving core 1*b*.

Figure 6:
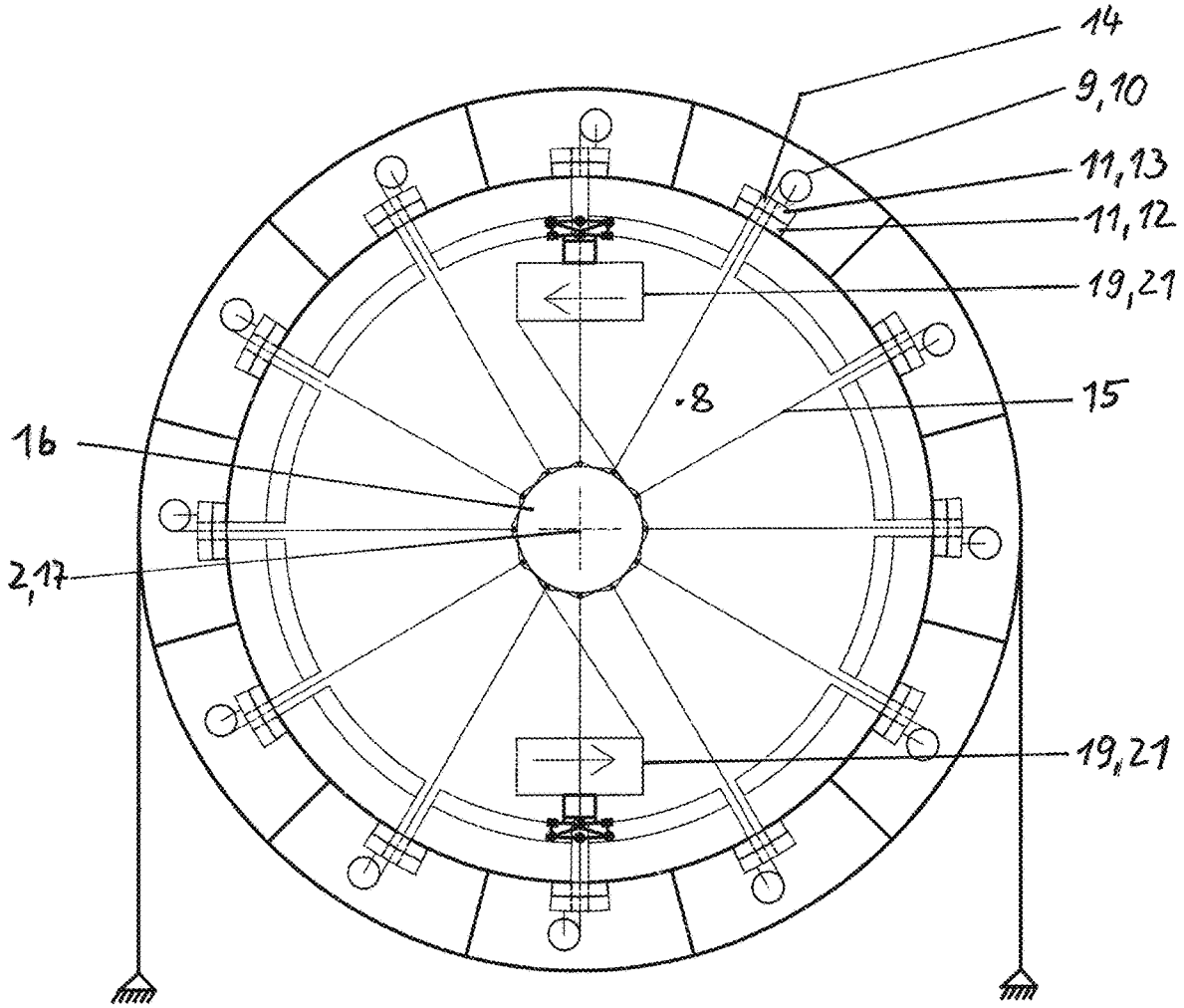
Figure 7A:
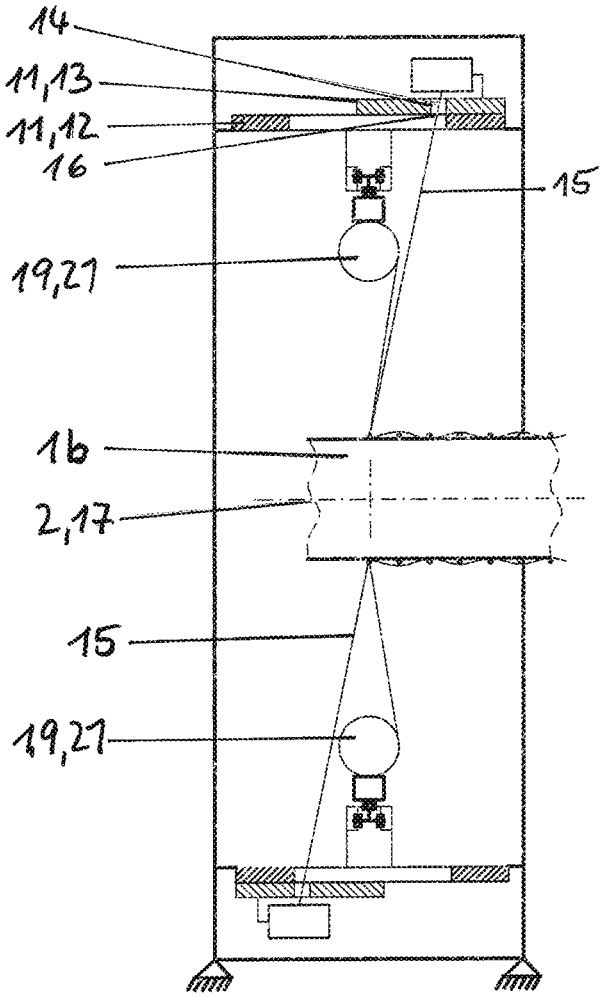

FIGS. 6, 7*a, b* show a third design of the circular loom according to the invention for weaving a cylindrical weaving core 1*b*.

The above description for the second design of the circular loom also applies in respect of the matching features and their advantages to the circular loom described here according to the third design, with the result that in this regard reference is made to the corresponding statements.

To avoid repetition, only the differences compared to the second version of the circular loom according to FIGS. 3 to 5 are described.

In this design, the 12 warp spool devices 9 are arranged in each case on one guide carriage 13 of the 12 guide devices 11 and are carried piggyback-style with the guide carriage.

The warp spool device 9 is arranged on the guide carriage 13 in such a manner that the warp thread spool 10 is located essentially in a straight-line extension to the radially directed thread channel 14 and hence always enables a deflection-free path of the warp thread 15 through the thread channel 14.

FIGS. 7*a, b* show two operating phases of the weaving process in the circular loom with alternating positioning of the guide carriages 13 with the warp spool devices 9 while both shuttles 19 travel around their orbit in each case by 180°.

In the operating phase according to FIG. 7*a*, the two orbiting shuttles 19 are in the 6 o'clock and 12 o'clock position of the circular loom, while at the same time, forming a warp thread shed, among other things the guide carriage 13 of the guide device 11 arranged in the 12 o'clock position with the warp spool device 9 and the warp thread 15 are located in the image plane to the right of the orbit path 3 and among other things the guide carriage 13 of the guide device 11 arranged in the 6 o'clock position with the warp spool device 9 and the warp thread 15 are located in the image plane to the left of the orbit path 3, while the shuttles 19 pass through the 6 o'clock and 12 o'clock position.

Figure 7B:
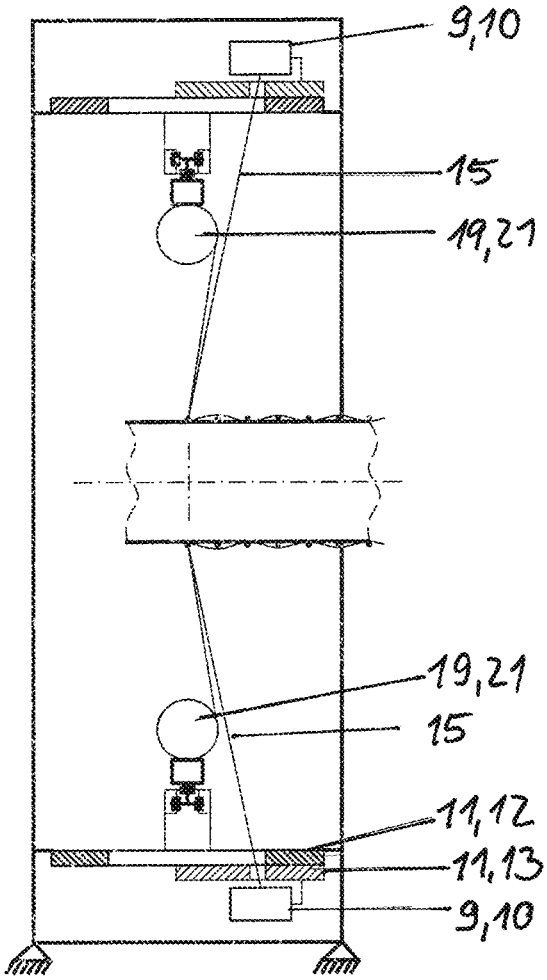

FIG. 7*b* shows the operating phase of the circular loom, in which the shuttle 19 that was previously in the 6 o'clock position is passing the 12 o'clock position and vice versa, while now among other things the guide carriages 13 of the guide devices 11 arranged in the 6 o'clock and 12 o'clock position with the warp spool device 9 and the warp thread 15 are located in the image plane to the right of the orbit path 3, while the shuttles 19 pass through the 6 o'clock and 12 o'clock position.

Figure 8C:
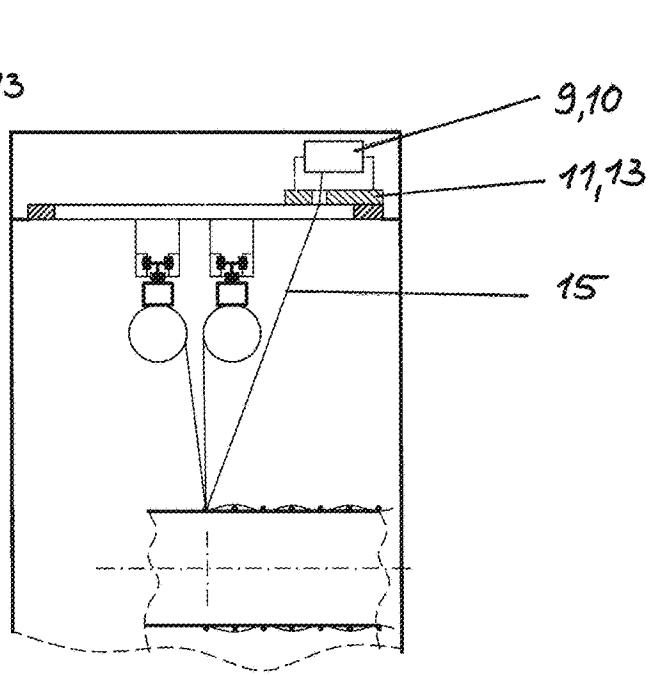
Figure 8B:
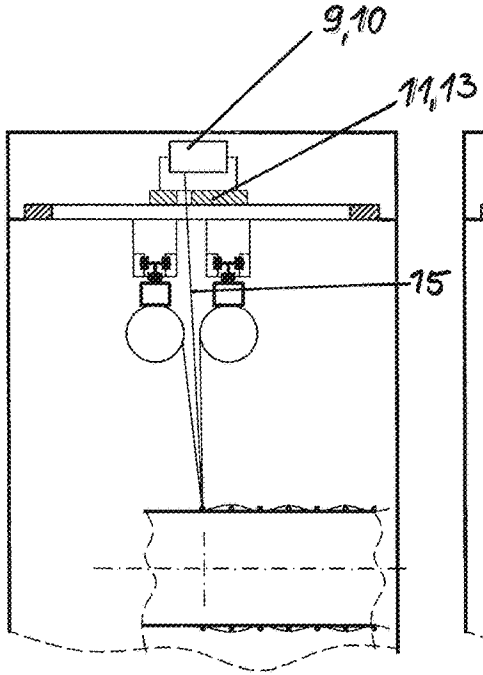
Figure 8A:
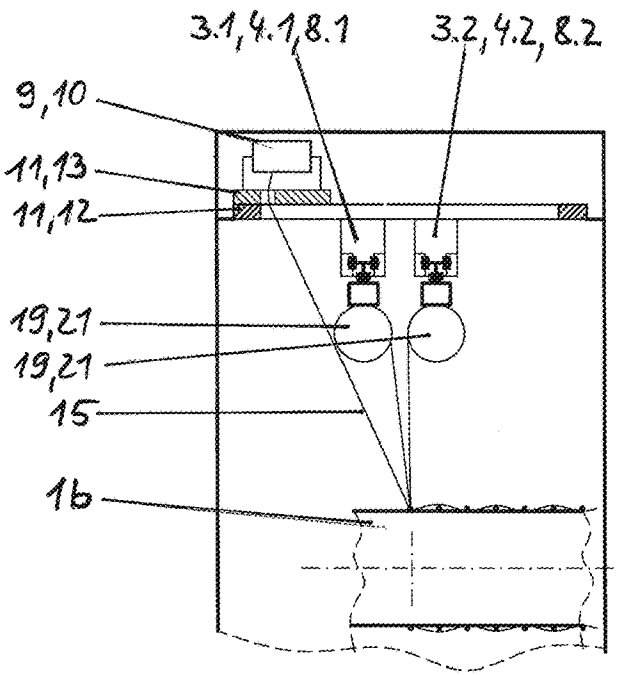

FIGS. 8*a, b, c* show a fourth design of the circular loom according to the invention for weaving a cylindrical weaving core 1*b*.

The above description for the third design of the circular loom also applies in respect of the matching features and their advantages to the circular loom described here according to the fourth design, with the result that in this regard reference is made to the corresponding statements.

To avoid repetition, only the differences compared to the third design of the circular loom according to FIGS. 6, 7*a, b* are described.

The circular loom according to this example embodiment has two circular orbit paths 3.1, 3.2 arranged parallel to each other for the rail-guided orbit of two shuttles 19 in each case.

To the two orbit paths 3.1, 3.2 are assigned a total of 12 guide devices 11, each of which carries one warp spool device 9 that is arranged on the respective guide carriage 13.

The base body 12 of each guide device 11 extends in the axial direction over the two track bodies 4.1, 4.2 of the orbit paths 3.1, 3.2 with the result that the guide carriage 13 and the carried warp thread 15 of each guide device 11 can along the base body 12 cross both track bodies 4.1, 4.2 and hence both track planes 8.1, 8.2 and corresponding to the example operating phase according to FIG. 8*a* can be positioned in the image plane to the left of the first orbit path 3.1, corresponding to the operating phase according to FIG. 8*b* centrally between the first and the second orbit path 3.1, 3.2 and corresponding to the operating phase according to FIG. 8*c* to the right of the second orbit path 3.2.

Figures 9A, 9B, 9C:
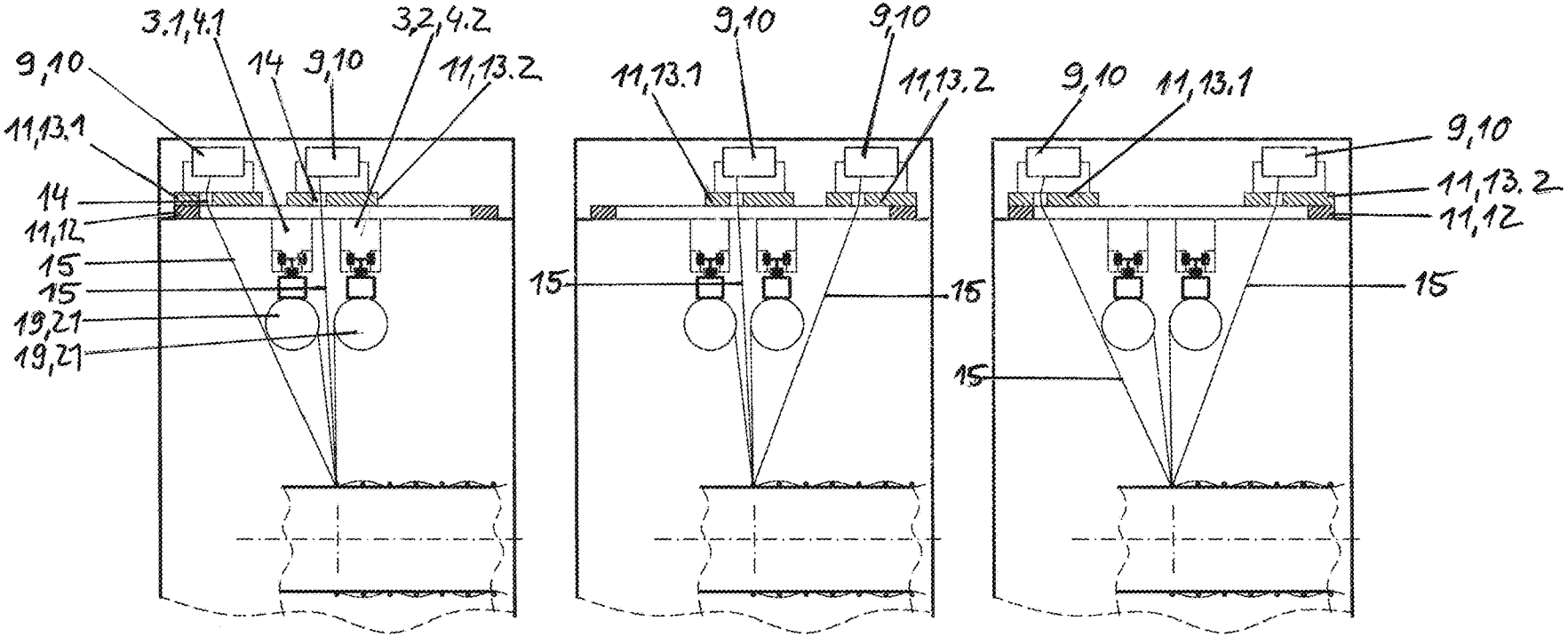

FIGS. 9*a, b, c* show a fifth design of the circular loom according to the invention for weaving a cylindrical weaving core 1*b*.

The description for the fourth design of the circular loom also applies in respect of the matching features and their advantages to the circular loom described here according to the fifth design, with the result that in this regard reference is made to the corresponding statements.

To avoid repetition, only the differences compared to the fourth design of the circular loom according to FIGS. 8*a, b, c* are described.

In this design, the 12 guide devices 11 in each case have two guide carriages 13.1, 13.2, with in each case a thread guide element 14.1, 14.2 as a radially directed thread channel 14.1, 14.2. On the thus resulting total of 24 guide carriages 13.1, 13.2 in each case a warp spool device 9 is arranged, which the guide carriages 13.1, 13.2 carry with them.

The two guide carriages 13.1, 13.2 of each guide device 11 can be positioned anywhere along the base body 12, which extends over both track bodies 4.1, 4.2 of the orbit paths 3.1, 3.2.

By way of example, during the operating phase according to FIG. 9*a*, the first guide carriage 13.1 and its carried warp thread 15 are located in the image plane to the left of the first orbit path 3.1 and the second guide carriage 13.2 and its carried warp thread 15 are located centrally between the first and the second orbit path 3.1, 3.2.

In the operating phase according to FIG. 9*b* the first guide carriage 13.1 and its carried warp thread 15 are located by way of example centrally between the first and the second orbit path 3.1, 3.2 and the second guide carriage 13.2 and its carried warp thread 15 are located to the right of the second orbit path 3.2.

In the operating phase according to FIG. 9*c* the first guide carriage 13.1 and its carried warp thread 15 are once again located in the position to the left of the first orbit path 3.1, while the second guide carriage 13.2 and its carried warp thread 13.2 have remained in the position to the right of the second orbit path 3.2.

In the designs according to the fourth and fifth example embodiments, an even greater number of possible weaving modes and generatable weaving structures can be realised while maintaining a high weaving speed and weaving quality.

Figure 10A:
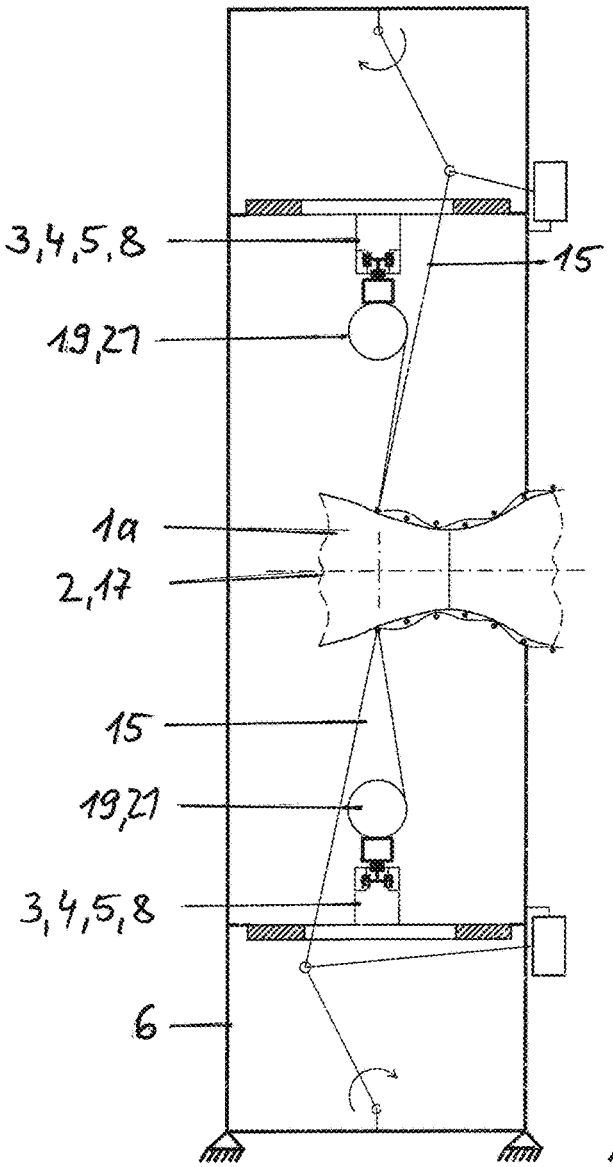

FIGS. 10*a, b* show a circular loom according to the invention in a sixth design for weaving a contoured, two-part weaving core 1*a*, analogous to the first design of the circular loom according to FIGS. 1, 2*a, b*.

The description for the first design of the circular loom also applies in respect of the matching features and their advantages to the circular loom described here according to the sixth design, with the result that in this regard reference is made to the corresponding statements.

To avoid repetition, only the differences compared to the first design of the circular loom according to FIGS. 1, 2*a, b* are described.

Assigned to the 12 warp spool devices 9 arranged fixed relative to the housing, alternatively 12 moving, pivotable guide devices 11 are provided, which are arranged concentrically around the central weaving axis 2 of the circular loom, outside of the circular orbit path 3 or track plane 8 and essentially in a lengthening of the radial extent of the orbit path 3 or track plane 8 on an outer wall of the machine housing 6 of the circular loom.

The pivotable guide devices 11 have in each case a swivel joint 27 arranged fixed relative to the housing as a base body 27 and a positioning part 28 mounted rotatably on the swivel joint 27, which in the example embodiment is designed as a swivel arm 28.

The swivel arm 28 has on its free end a thread guide element 29 for guiding and steering the warp thread 15 in the form of a thread guide eye 29, through which the warp thread 15 is guided.

By means of the alternatingly pivotable swivel arm 28 with the thread guide eye 29, the warp thread 15 can to form the thread shed be moved in an alternating manner to both sides of the segmented orbit path 3, while with little frictional force in the thread guide eye 29 only one thread deflector is necessary.

The longer the swivel arm 28 is designed, the smaller is the resulting radius of the travel path of the thread guide eye 29 and hence of the movement path of the warp thread 15.

The feeding of the warp threads 15 from the warp thread spools 10 via the thread guide eye 29 on to the weaving point on weaving core 1*a* thus here too takes place largely in a straight line, whereby the thread tension of the warp threads 15 can be maintained at a high level.

The alternating movement of the swivel arm 28 of each guide device 11 can be generated and controlled analogously to the design according to FIGS. 1, 2*a, b* individually, e.g. via single switchable direct drives acting in two directions (not shown).

In FIGS. 10*a, b* the two orbiting shuttles 19 are shown schematically in the 6 o'clock and 12 o'clock position respectively along the orbit path 3.

For the sake of clarity, FIGS. 10*a, b* each show only two warp spool devices 9 and the associated pivotable guide devices 11, namely the warp spool devices 9 and guide devices 11 arranged in the 6 o'clock and 12 o'clock position of the circular loom.

FIGS. 10*a, b* show two operating phases of the weaving process in the circular loom with alternating positioning of the swivel arms 28 with the thread guide eyes 29 guiding the warp threads 15 while the two shuttles travel around their orbit 19 in each case by 180°.

In the operating phase according to FIG. 10*a*, the two orbiting shuttles 19 are in the 6 o'clock and 12 o'clock position of the circular loom, while among other things the swivel arm 28 with the warp thread 15 in the thread guide eye 29 of the guide device 11 arranged in the 12 o'clock position is pivoted out in the image plane to the right of the orbit path 3 and among other things the swivel arm 28 with the warp thread 15 of the guide device 11 arranged in the 6 o'clock position is pivoted out in the image plane to the left of the orbit path 3, with the result that the space for the passage of the shuttles 19 at the 6 o'clock and 12 o'clock position is cleared by the warp threads 15 which are spread out away from the track plane 8 forming a shed.

Figure 10B:
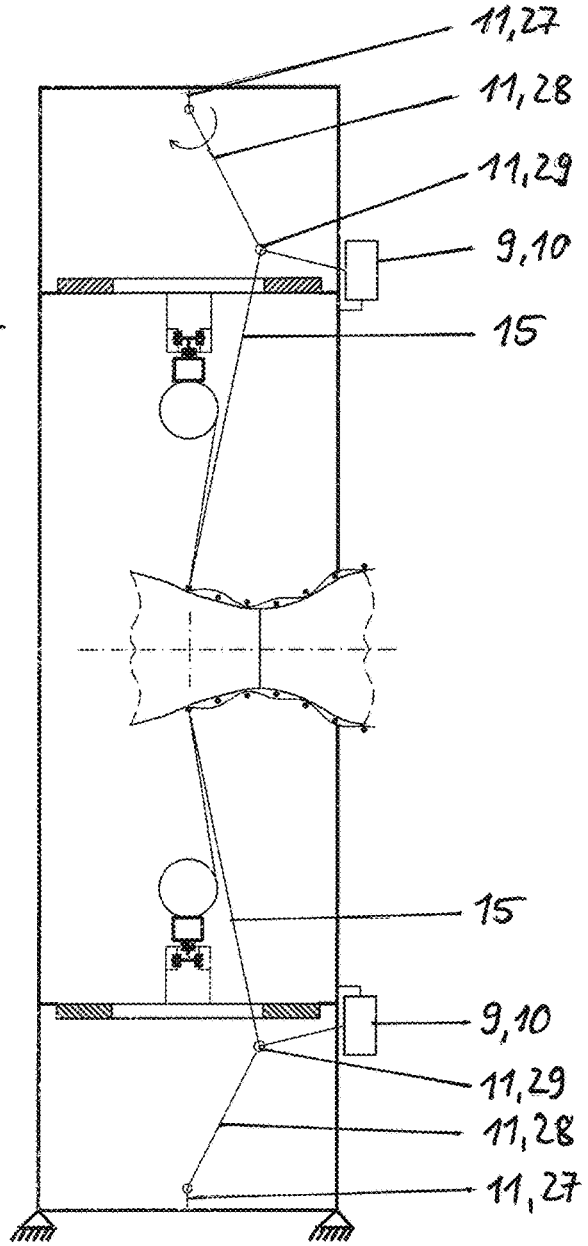

FIG. 10*b* shows the operating phase of the circular loom in which the shuttle 19 that was previously located in the 6 o'clock position is passing the 12 o'clock position and vice versa, while among other things the swivel arms 28 with the warp threads 15 of the guide devices arranged in the 6 o'clock and 12 o'clock position are pivoted out in the image plane to the right of the orbit path 3, while the shuttles 19 pass through the 6 o'clock and 12 o'clock position.

LIST OF REFERENCE NUMERALS

1 Weaving core, non-uniform a, cylindrical b
2 Weaving axis of the circular loom
3 Circular orbit path, first 0.1, second 0.2
4 Track body first 0.1, second 0.2
5 Track segment
6 Machine housing
7 Guide rail
8 Track plane, first 0.1, second 0.2
9 Warp spool device
10 Warp thread spool
11 Guide device
12 Base body of the guide device
13 Positioning part, guide carriage first 0.1, second 0.2
14 Thread guide element, thread guide channel, thread channel, first 0.1, second 0.2
15 Warp thread
16 Thread outlet
17 Weaving core axis
18 Recess in the orbit path, gap
19 Shuttle
20 Shuttle carriage
21 Weft thread spool
22 Weft thread
23 Guide roller
24 Passage in the base body
25 Fabric
26 Weaving ring
27 Base body of the guide device, swivel joint
28 Positioning part, swivel arm
29 Thread guide element, thread guide eye

What is claimed is:

1. A circular loom for weaving a weaving core with at least one shuttle, which comprises a weft thread spool and is movable along a circular orbit path around the weaving core, wherein at least one guide device configured to guide at least one warp thread provided from a warp thread spool of a warp spool device is provided and movably arranged or designed outside a track plane enclosed by an outer circumference of the circular orbit path, the guided warp thread, crossing the track plane, passing through a recess in the circular orbit path.

2. The circular loom of claim 1, wherein the movable guide device comprises at least one movable or pivotable positioning part.

3. The circular loom of claim 1, wherein a thread guide element of the guide device is configured as a thread guide channel, as a thread guide groove or as a thread guide eye.

4. The circular loom of claim 2, wherein a thread guide element of the guide device is configured as a thread guide channel, as a thread guide groove or as a thread guide eye.

5. The circular loom of claim 2, wherein the positioning part is configured to be linearly movable.

6. The circular loom of claim 4, wherein the positioning part is configured to be linearly movable.

7. The circular loom of claim 2, wherein the warp thread spool of at least one warp spool device is arranged essentially in a straight extension of a path of the warp thread through a thread guide element and/or essentially in a straight extension of a travel or pivot path of the thread guide element.

8. The circular loom of claim 3, wherein the warp thread spool of at least one warp spool device is arranged essentially in a straight extension of a path of the warp thread through a thread guide element and/or essentially in a straight extension of a travel or pivot path of the thread guide element.

9. The circular loom of claim 4, wherein the warp thread spool of at least one warp spool device is arranged essentially in a straight extension of a path of the warp thread through a thread guide element and/or essentially in a straight extension of a travel or pivot path of the thread guide element.

10. The circular loom of claim 5, wherein the warp thread spool of at least one warp spool device is arranged essentially in a straight extension of a path of the warp thread through a thread guide element and/or essentially in a straight extension of a travel or pivot path of the thread guide element.

11. The circular loom of claim 6, wherein the warp thread spool of at least one warp spool device is arranged essentially in a straight extension of a path of the warp thread through a thread guide element and/or essentially in a straight extension of a travel or pivot path of the thread guide element.

12. The circular loom of claim 1, wherein the warp thread spool of at least one warp spool device is arranged essentially in a lengthening of a radial extent of the circular orbit path.

13. The circular loom of claim 1, wherein at least one warp spool device is arranged on the movable guide device.

14. The circular loom of claim 1, wherein the circular orbit path comprises at least one guide rail or is formed by at least one guide rail, in or on which at least one shuttle is guided.

15. The circular loom of claim 1, wherein a guiding and/or a drive of the shuttle is magnetic and/or electromagnetic.

16. The circular loom of claim 1, wherein a second circular orbit path is provided, along which in each case at least one shuttle is movable, the guided warp thread, crossing track planes of a first and/or second orbit path, passing through the recess of the first and/or second circular orbit path.

* * * * *